United States Patent [19]

Zahavkochav

[11] 4,183,111

[45] Jan. 15, 1980

[54] SLEEPING BAGS

[76] Inventor: Pelepa Zahavkochav, P.O. Box 190, Goulburn, Australia, 2580

[21] Appl. No.: 943,074

[22] Filed: Sep. 18, 1978

[30] Foreign Application Priority Data

Sep. 22, 1977 [AU] Australia ..... PD1774

[51] Int. Cl.[2] ..... A47G 9/08

[52] U.S. Cl. ..... 5/343; 5/337

[58] Field of Search ..... 5/343, 337; 2/69.5

[56] References Cited

U.S. PATENT DOCUMENTS 3,965,505 6/1976 Thorowgood ..... 5/343

FOREIGN PATENT DOCUMENTS 2358132 2/1978 France ..... 5/343

898653 6/1962 United Kingdom ..... 5/343

*Primary Examiner*—Alexander Grosz

*Attorney, Agent, or Firm*—Townsend and Townsend

[57] ABSTRACT

This invention provides a sleeping bag construction which may be used for sleeping either one person or two persons. Basically this is accomplished by providing a pair of pockets on the outside of a single sleeping bag with a module removably attached to the bag inside each pocket, which is open at the head so that each module can fold outwardly to form a pillow at the head of the bag. For a single bag only the bottom module need be folded out. The single bag is so constructed that it can be opened out and used as the bottom panel of a double sleeping and a similar panel with or without pockets and modules but with matching edge fasteners can be used as the top panel. In this way the modules of the bottom panel can be folded out to form two pillows side by side.

7 Claims, 20 Drawing Figures

SLEEPING BAGS

BACKGROUND OF THE INVENTION

This invention relates to sleeping bags.

Single and double sleeping bags are well known, but most of the types available are suitable—as their name indicates—for sleeping only one person, or only two persons. That is to say, two persons cannot squeeze into a single bag and a double bag is not suitable for sleeping one person only, especially in cold environments. In the past, these problems have been approached by constructing double sleeping bags of two separate panels which are zip-fastened together along three adjacent edges. Each panel, when separated, can be folded along a centre-line to form a single bag, with the bottom and the free side edges being zip-fastened, and the side of the bag opposite the zip-fastened side being formed along the line of folding. The top edges, of course, are not joined together and this provides an entrace to the bag at the head thereof. A further approach to the above problems has been disclosed in U.S. Pat. No. 3,965,505 to S. W. Thorowgood.

The Thorowgood Patent discloses a double sleeping bag having a pair of panels which are fastened together along the bottom and the side edges leaving the edges at the head or "top" of the bag unfastened to provide an entrance thereto. The bag is so constructed and arranged that it can be folded along its centreline whereby one of the panels forms the outside and the other panel forms the inside of a double sleeping bag.

In effect, this is a similar arrangement to that previously tried except that two panels rather than one panel are folded to form a single sleeping bag. All of these prior arrangements involve problems when hooded bags are used. For example, the bottom panel of a hooded double sleeping bag cannot be folded to form a single sleeping bag as the resulting bag would have a hood affixed below and above a sleeper's head. Similarly, two hooded single sleeping bags cannot be satisfactorily joined together to make a hooded sleeping bag of double size as the resulting bag would have a hood on its bottom panel and a hood on its top panel instead of two hoods side by side on the bottom panel. This applies where each single bag is opened out into a double size panel first, before being joined to the other, but not where the two single bags are joined together without being opened out. This latter arrangement has its own disadvantages as described in the Thorowgood Patent at Column 1, paragraph 1. Viz—the sleeping bags must in general be of similar design and the method of joining results in the zip fastener being positioned in the module of the resulting bag.

SUMMARY OF THE INVENTION

It is therefore the object of this invention to provide a sleeping bag construction which will obviate the foregoing problems.

This is basically achieved by providing a pair of pockets on a single sleeping bag on the outside thereof, one on the top panel portion and one on the bottom panel portion. There is a module removably attached to the bag inside each pocket, and the pockets are open at the head of the bag so that each module can fold outwardly therefrom to form a pillow at the head of the bag. For a single bag, obviously, only the bottom module is folded out although the top module can be removed and used as an extra pillow. The single bag is so constructed that it can be opened out and used as the bottom panel of a double sleeping bag, and a similar panel with or without the pockets and modules, but with matching fasteners along the edges thereof, can be used as the top panel. In this way the modules of the bottom panel can be folded out to form two pillows side by side. The modules are constructed with a drawstring which when tightened pulls them into the shape of a hood. This can be alternative to use as a pillow, or, in cold environments, additional. i.e. as the single bag, the top module is removed from its pocket, detached from the bag, and re-attached to the bottom panel over the pillow in the form of a hood. Where a double bag has been made up using two single bags of the invention, a similar arrangement of hoods and pillows, can be set up.

The invention consists of the foregoing and also envisages constructions of which the following description gives examples only, and where specific integers are mentioned therein which have known equivalents in the art to which this invention relates, such known equivalents are deemed to be incorporated herein as if individually set forth.

BRIEF DESCRIPTION OF THE DRAWINGS

A preferred form of the invention is illustrated in the accompanying drawings, in which.

Figure 4:
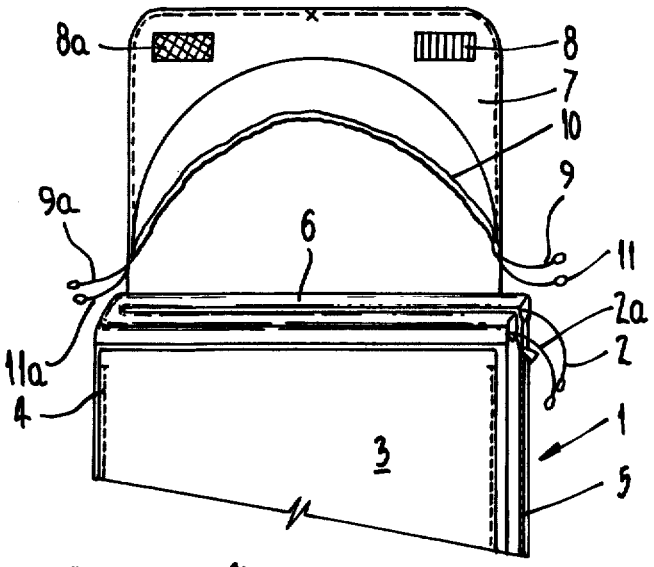
FIGS. 4 and 4*a* are part-views of the bag with both modules in use i.e. one as a pillow and one as a hood.
Figure 4A:
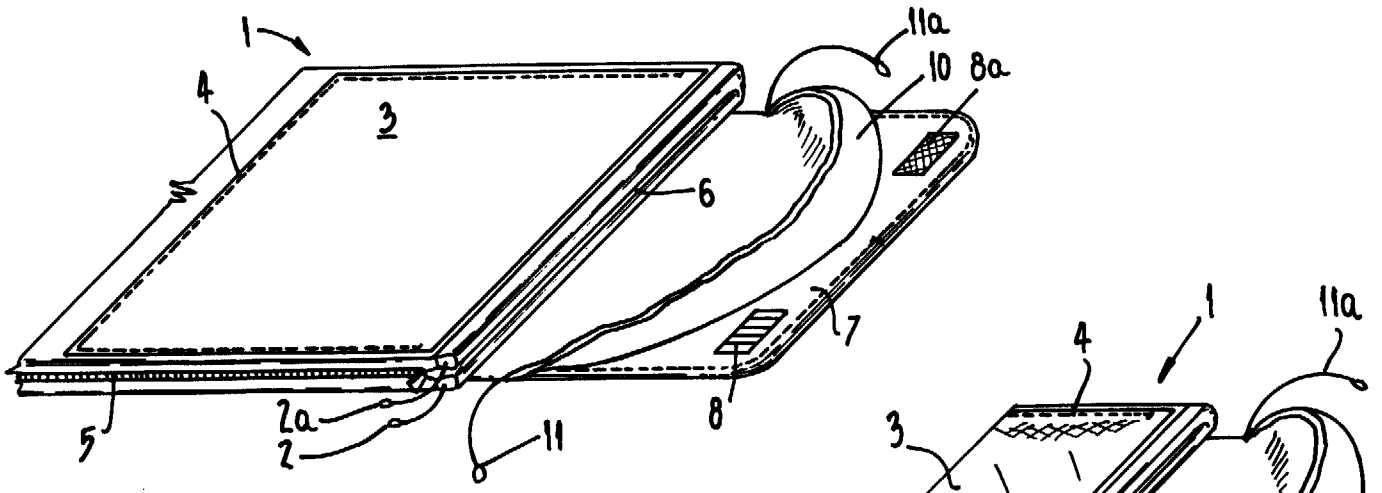

This figure corresponds to FIGS. 4 and 4*a;*

Figure 7:
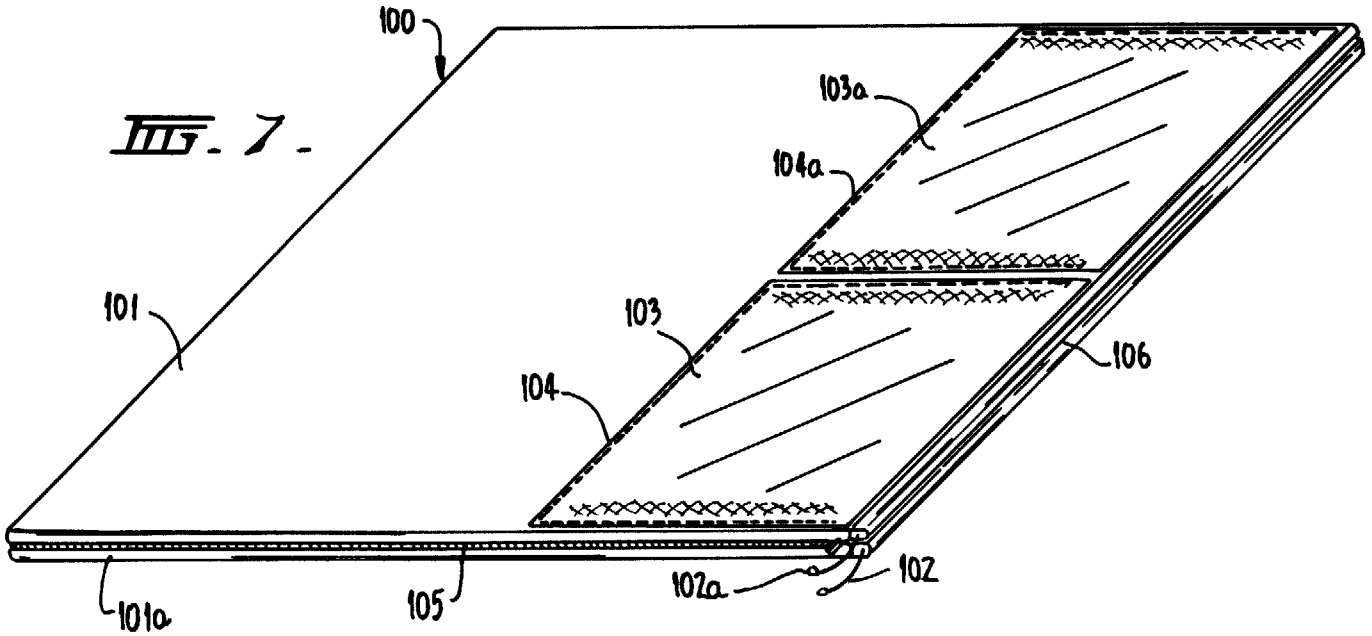
FIG. 7 illustrates a double bag constructed from two single bags of the type illustrated mainly in FIGS. 1, 1*a* and 2.
Figure 7A:
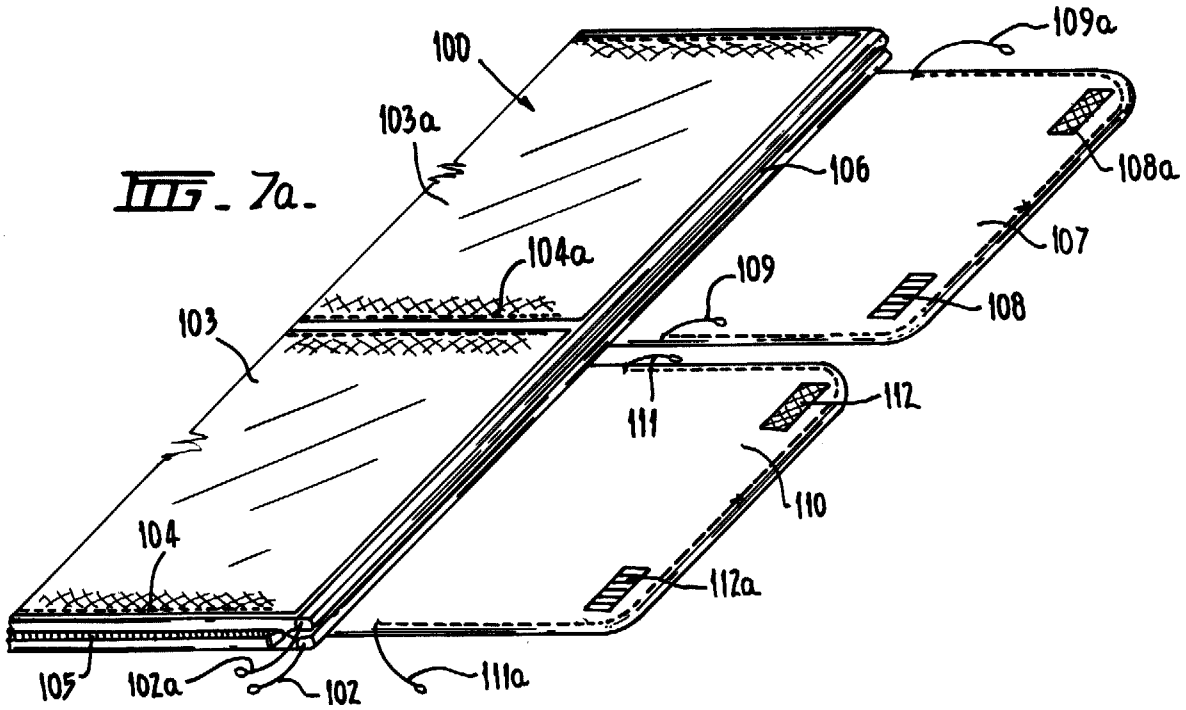
FIG. 7*a* is a part-view of the bag of FIG. 7 with the two modules from the bottom panel in position to act as pillows. This Figure corresponds to FIGS. 3 and 3*a;*
Figure 7B:
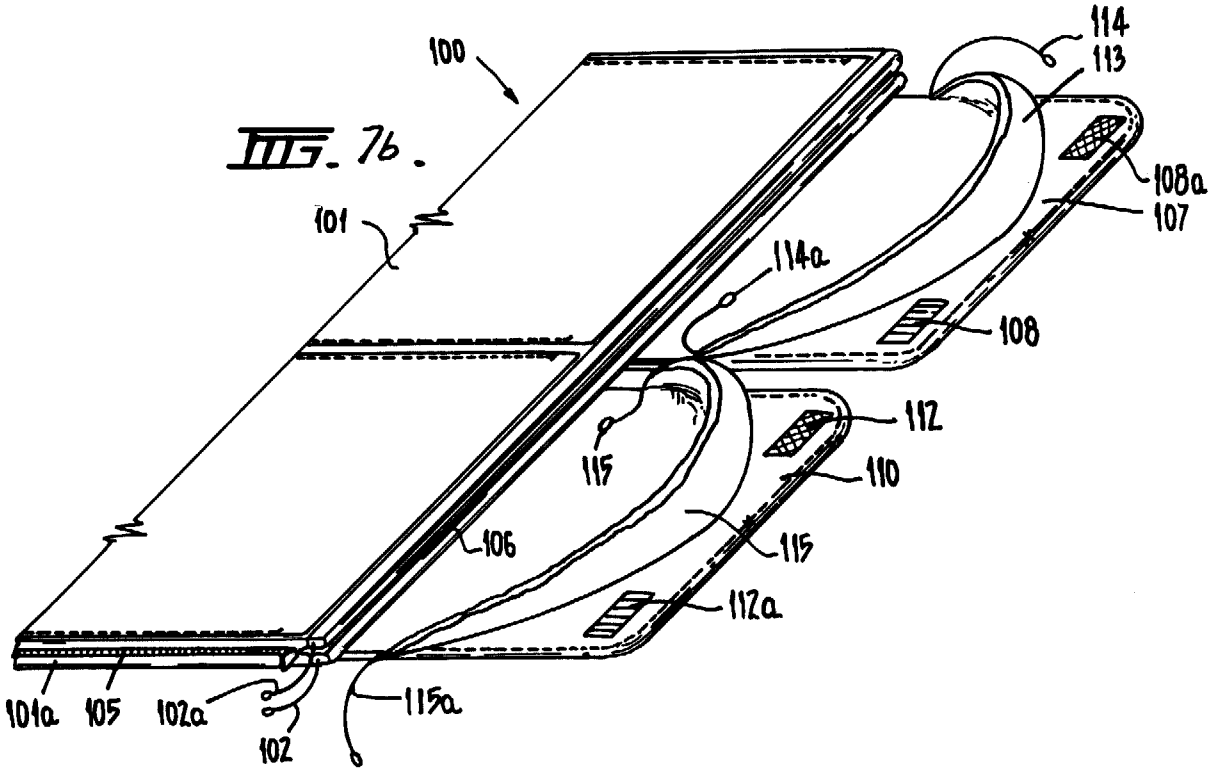
FIG. 7*b* is a part-view of the bag showing the four modules in position to act as pillows and hoods respectively.
Figure 7C:
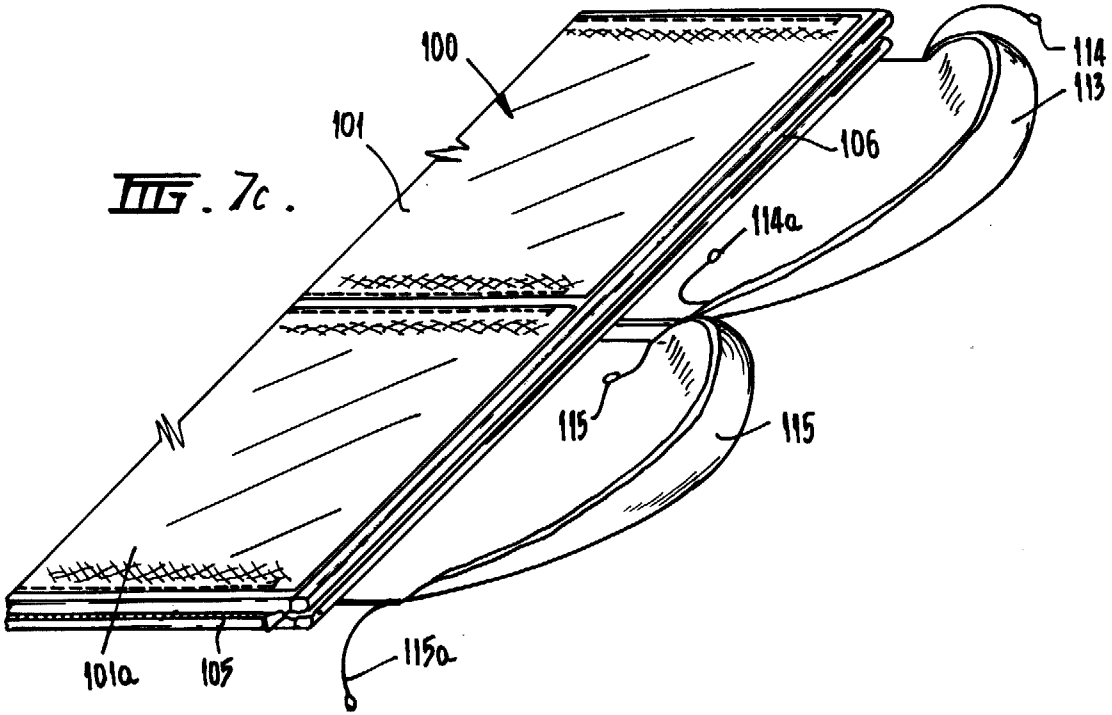

FIG. 7*c* is a part-view of the bag showing two modules only in use, acting as hoods. This figure corresponds to FIGS. 5 and 5*a;*

Figure 1:
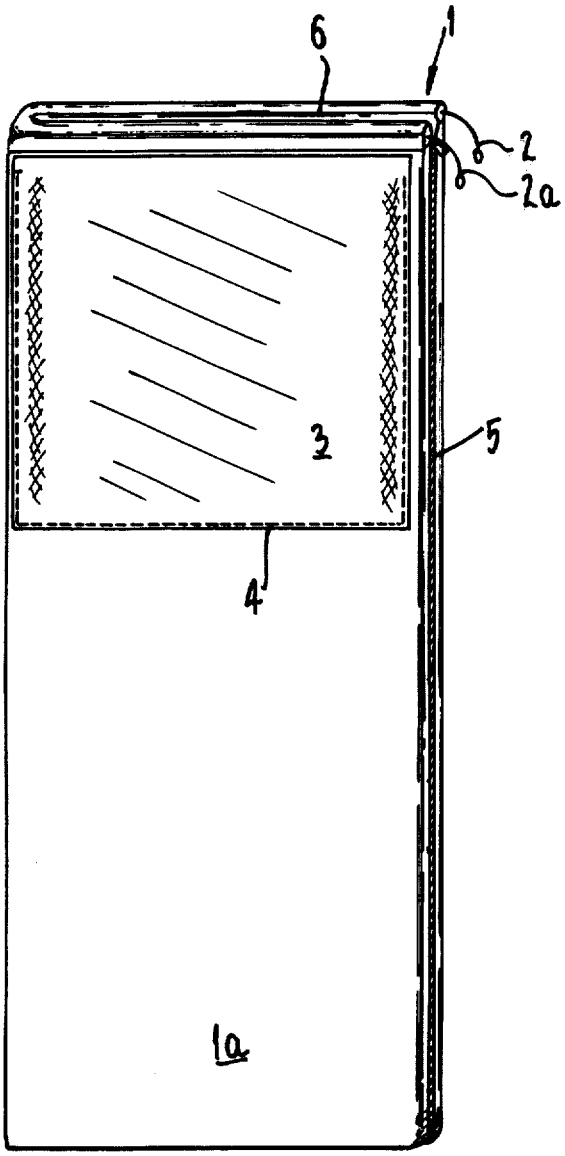
FIGS. 1 and 1*a* are different views of a single sleeping bag.
Figure 1A:
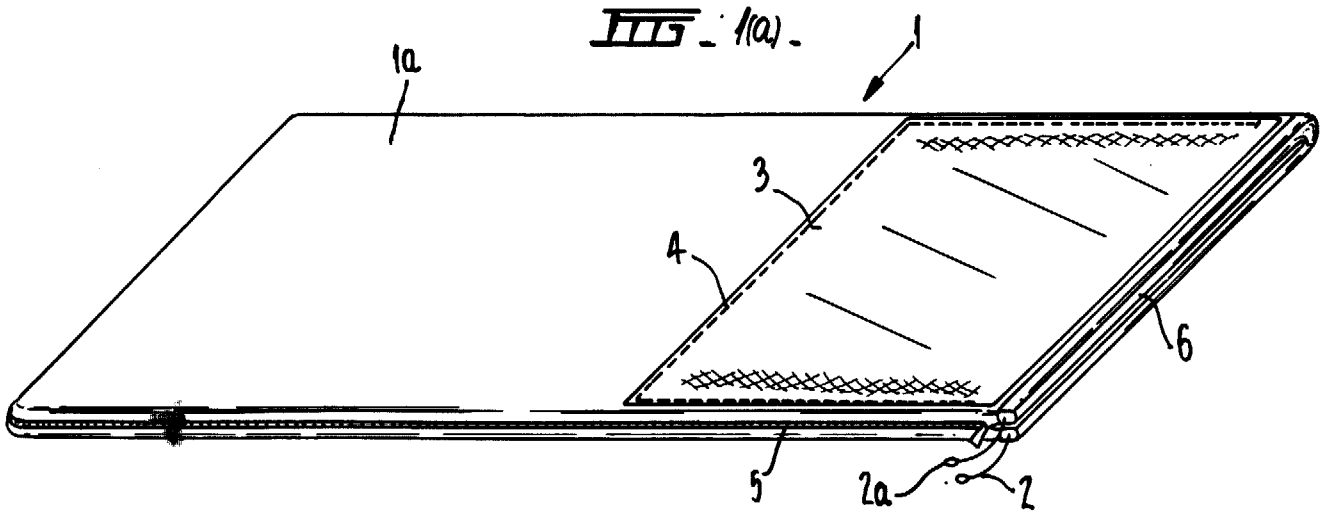
Figure 2:
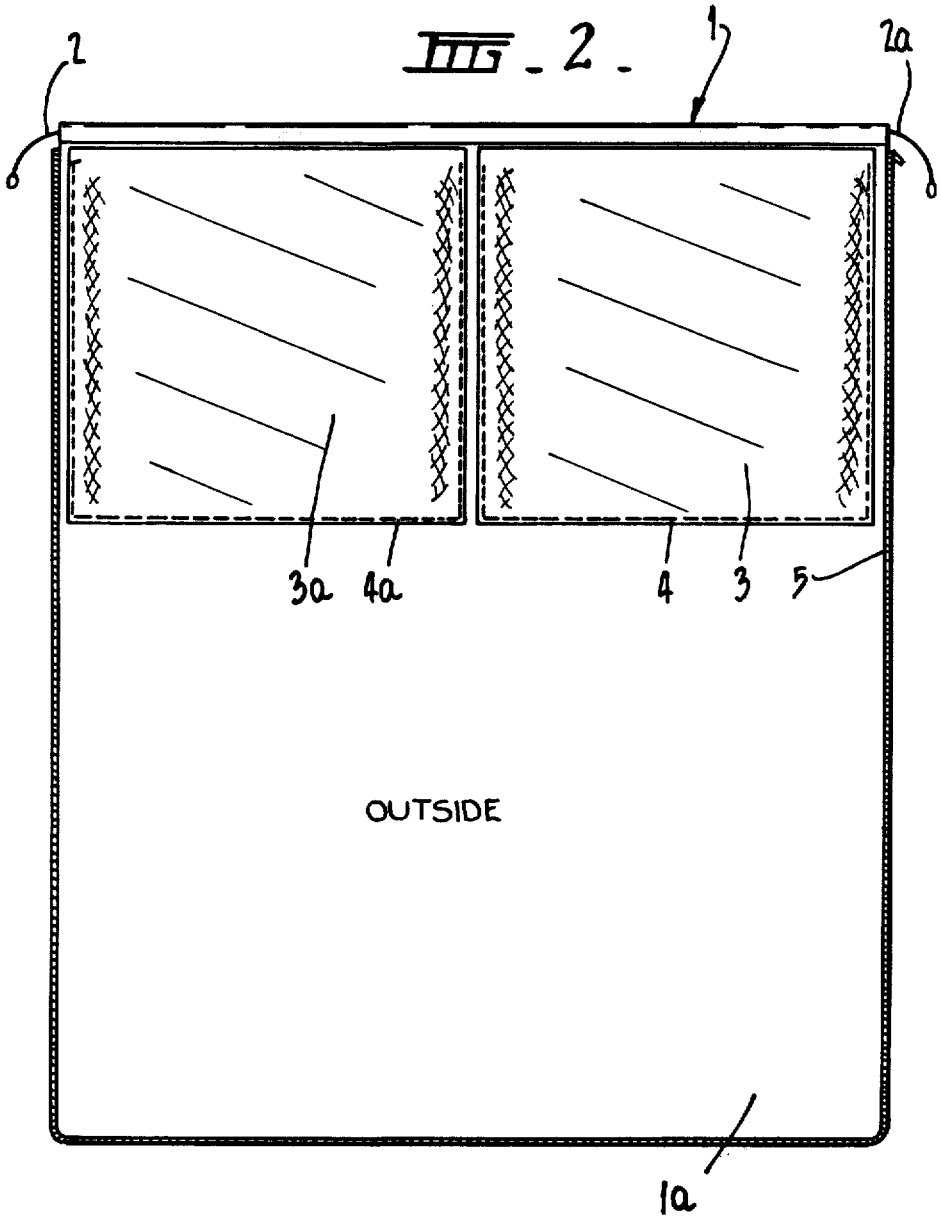
FIG. 2 illustrates the bag of FIGS. 1, 1*a* opened out to form one panel of a double bag.
Figure 8:
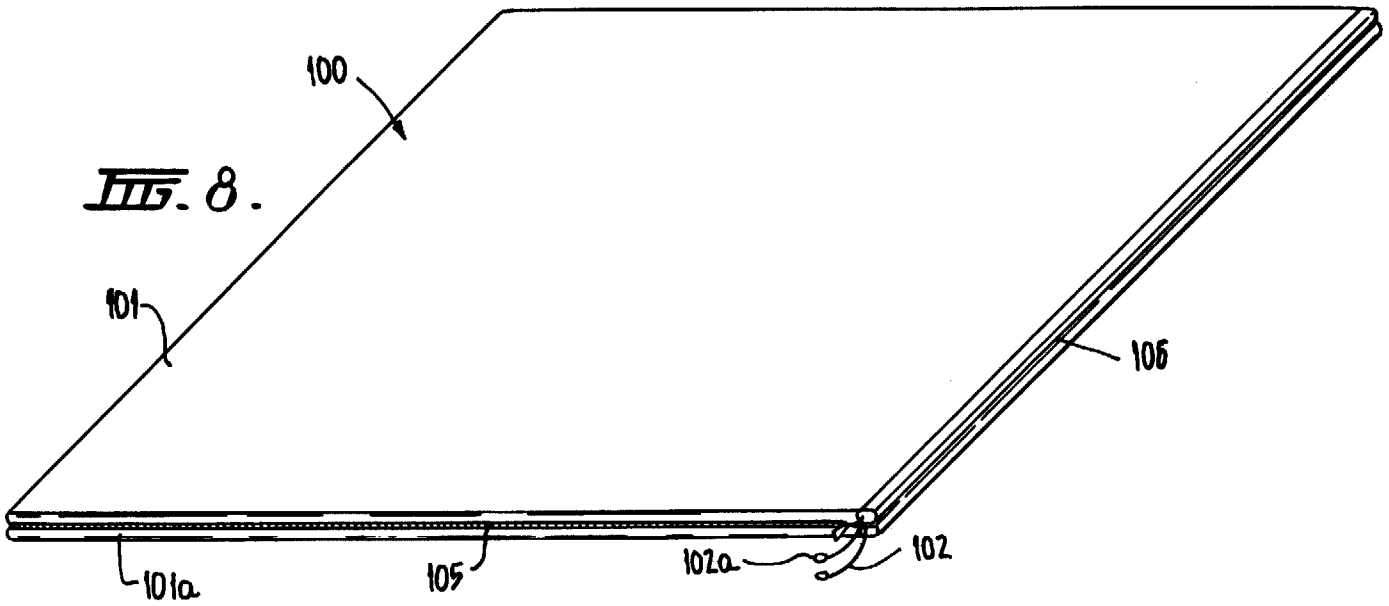
Figures 8A, 8B:
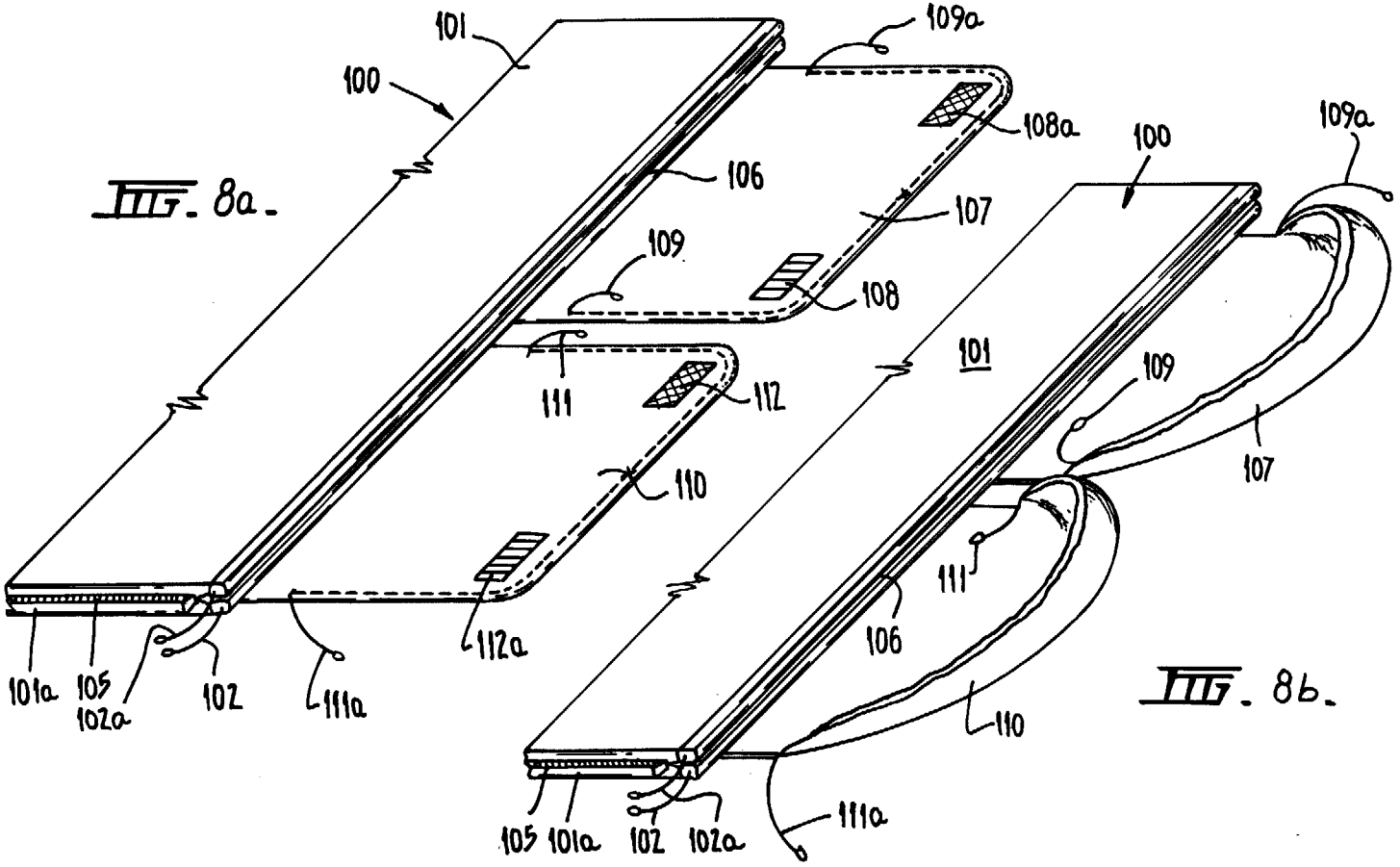
Figure 9:
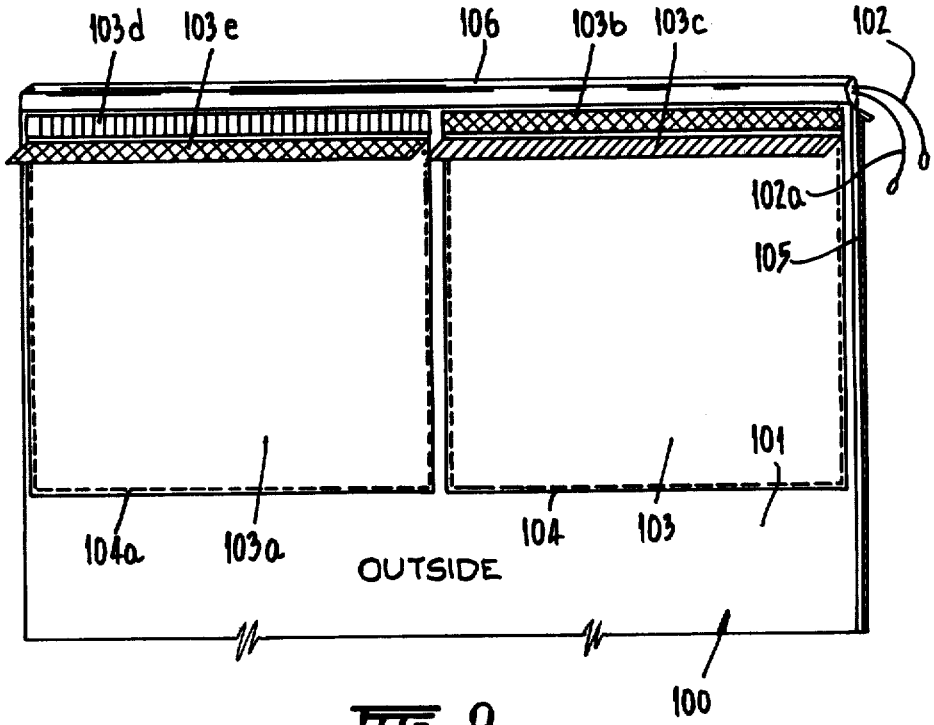

FIG. 8 illustrates a double bag made from a standard double bag (i.e. no pockets and modules) opened out to form the top panel, and a single bag of the type illustrated in FIGS. 1, 1*a* and 2 opened out to form the bottom (underneath) panel;

FIG. 8*a* shows a part-view of the bag of FIG. 8 with the two modules in position to act as pillows;

FIG. 8*b* shows a part-view of the bag of FIG. 8 with the two modules in position to act as hoods;

FIG. 9 is a part-view of a panel constituting the bag of FIGS. 1, 1*a* and 2; this is the same type of panel as either one of the panels forming the bag of FIGS. 7, 7*a*, 7*b* and 7*c*, or the same as the bottom panel of the bag of FIGS. 8, 8*a* and 8*b*.

DETAILED DESCRIPTION OF THE INVENTION

In the preferred form of the invention, a sleeping bag construction is provided as follows. FIGS. 1 to 5*a* inclusive illustrate a panel in accordance with the invention which can be folded in half to form a single sleeping bag (see FIGS. 1, 1*a*, 3) or opened out (see FIG. 2) to form a panel which can be used as the bottom panel for construction of a double sleeping bag. The outside surface of the panel is indicated by 1*a*, and a drawstring having ends 2, 2*a* is provided so that opening 6 at the head of the bag can be closed up around a user's shoulders. Pockets 3, 3*a* are sewen on the sides by stitching 4, 4*a* respectively, but are left open at the head of the bag. The panel 1 preferably rectangular in shape, is provided with a peripheral zip fastener 5, so that when the panel is folded in half, the open side and bottom can be sealed to form an enclosed bag, apart from the entrance opening 6.

Figure 3:
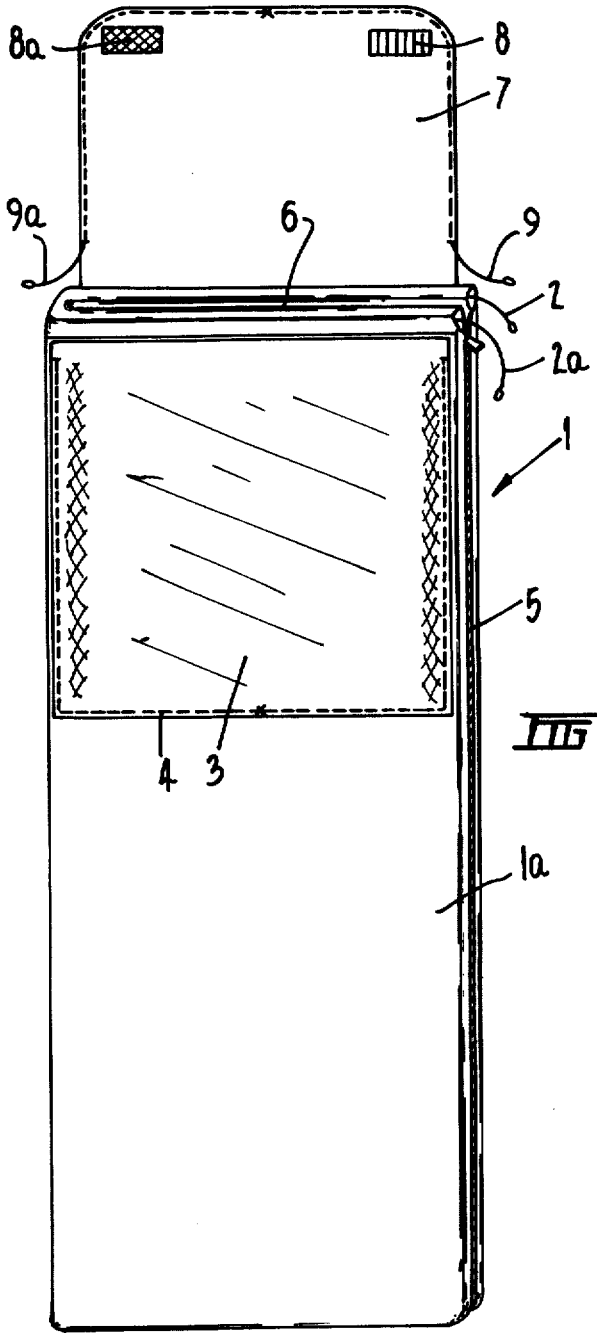
FIGS. 3 and 3*a* illustrate the bag (FIG. 3*a* being a part-view thereof) with one of the modules out of its pocket in position to act as a pillow.
Figure 3A:
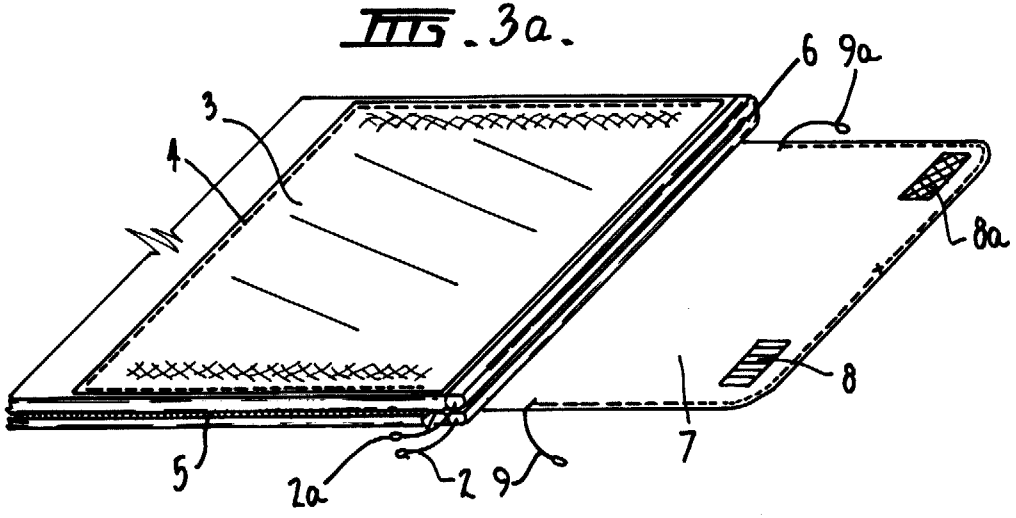
Figure 5:
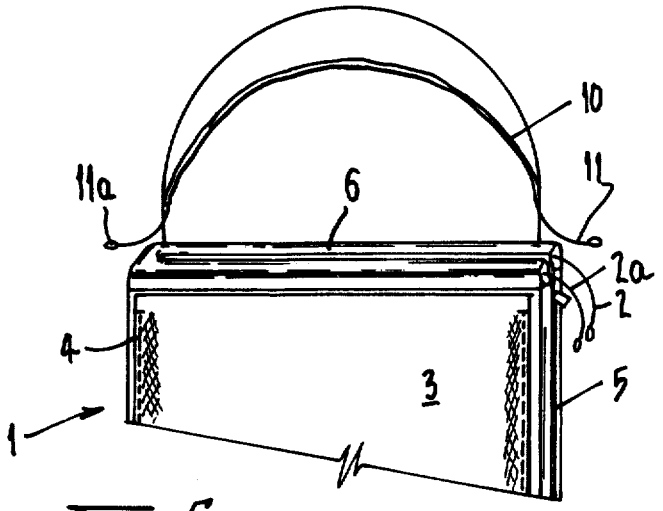
FIGS. 5 and 5*a* are part-views of the bag using one module only, as a hood.
Figure 5A:
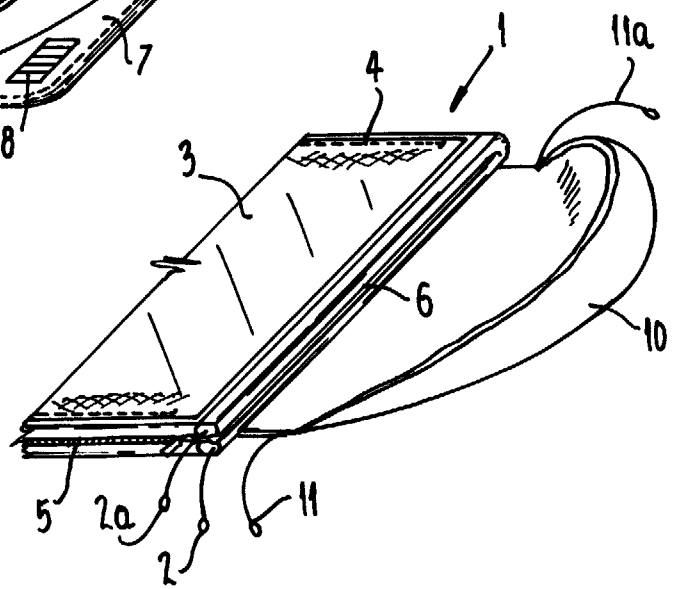

In each of the pockets 3, 3*a* is a module, respectively 10 and 7. When the panel 1 is being used to construct a single sleeping bag only the bottom module 7 is folded out of its pocket, (see FIGS. 3, 3*a*) to form a pillow, leaving its inner end attached to the bag. In an especially cold environment, it may be desirable to have a hood in addition to a pillow. In this case, module 10 is removed from its pocket and fastened to the bottom panel portion of the bag over pillow module 7. A drawstring is provided having ends 11, 11*a*, which, when tightened, draws the module up into the form of a hood (see FIGS. 4, 4*a*). Alternatively, it may be desired to use one module as a hood, but not to have a pillow. Such an arrangement is illustrated in FIGS. 5, 5*a*. Note that module 7 also has a drawstring having ends 9, 9*a*, so that it, too can be used as a hood. This is important if panel 1 is to be used as the bottom panel of a double sleeping bag.

Figure 6:
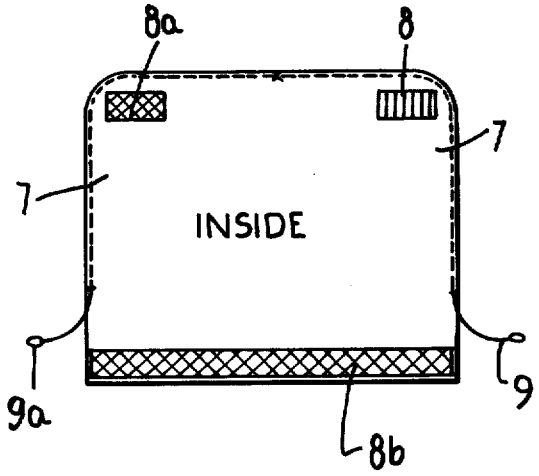
FIGS. 6 and 6*a* illustrate the pair of modules for the bag (inwardly facing sides thereof) showing the complementary fastening arrangements.
Figure 6A:
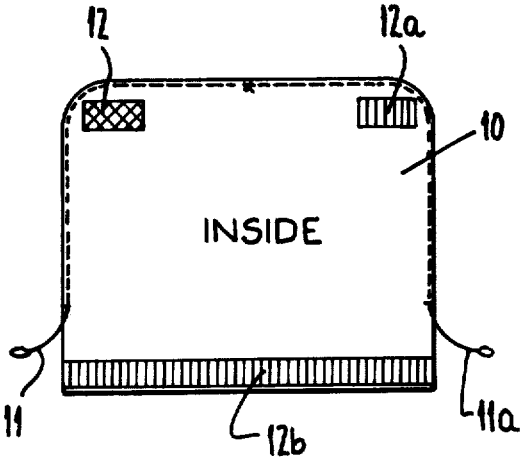
Figure 6B:
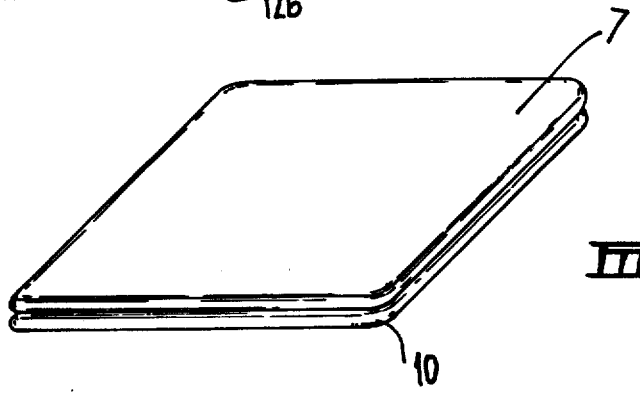
FIG. 6*b* illustrates the modules of FIGS. 6 and 6*a* fitted together to form a cushion or double thickness pillow.

The modules are more specifically illustrated in FIGS. 6, 6*a* and 6*b*. Items 8, 8*a*, 8*b* are fasteners of complementary forms to 12*a*, 12 and 12*b* on the other module. There is an immediate purpose in this arrangement in that the modules 7 and 10 can be fitted together as in FIG. 6*b* to form a cushion or a double thickness pillow. Additionally the fasteners 8 and 8*a* on module 7 are complementary so that by fitting them together, a hood or enclosure of more positive form is developed. Similarly, fasteners 12, 12*a* on module 10 are complementary.

The mode of attaching the modules 7, 10 to panel 1 can be discerned from a study of FIGS. 6, 6*a* and 9. FIG. 9 illustrates a panel 101 in accordance with the invention (i.e. identical to the panel of FIG. 2). This panel 101 is a panel of a double sleeping bag 101 with entrance opening 106. Pockets 103, 103*a* (identically constructed to pockets 3, 3*a*) are stitched to the outsides of panel 101 by stitching 104, 104*a*. For illustration purposes, the top edge of each pocket is shown folded back so that the fasteners to which the modules are attached can be seen. The fasteners 103*b*, 103*c* are complementary so that pocket 103 can be closed when desired. Similarly, fasteners 103*d*, 103*e* are arranged so that pocket 103*a* can also be closed. To illustrate more closely the working of the invention, visualise module 10 of FIG. 6*a* to be fitted in pocket 103*a*. It will be attached by fastener 12*b* to complementary fastener 103*e* and folded back into the pocket when not in use. If panel 101 is a bottom panel of a double sleeping bag, module 10 is folded out to lie on the ground as a pillow, while still attached by 12*b* to 103*e*. Supposing that a hood is also required, visualise module 7 fitted so that fastener 8*b* is attached to fastener 103*d*; if the ends of the drawstring 9, 9*a* are then pulled out, module 7 will form a hood lying above module 10, as illustrated in the various Figures e.g. FIG. 7*b*.

FIGS. 7, 7*a*, 7*b*, 7*c* illustrate a double sleeping bag constructed of two panels of the type shown in FIG. 2. FIGS. 7, 7*a*, 7*b*, 7*c* correspond respectively to FIGS. 1, 3 and 3*a*, 4 and 4*a*, and 5 and 5*a*. Note that like numerals indicate like integers.

FIGS. 8, 8*a* and 8*b* correspond respectively to FIGS. 7, 7*a* and 7*c* and illustrate a double sleeping bag constructed with a bottom panel in accordance with the invention (i.e. as shown in FIG. 2) and a "standard" top panel i.e. one not having any pockets and modules. This top panel can be a standard single sleeping bag opened out, and having peripheral fastenings matching those of the bottom panel.

Note that all the fasteners illustrated can be of any known suitable type, although it is preferred to use zip fasteners for the panel peripheries and velco fasteners, or studs for the pockets and modules.

The panels are typical of sleeping bag construction in that they comprise a double wall of natural or synthetic material enclosing an insulating material, with their outside surfaces preferably being waterproof. The modules are similarly constructed.

It will be appreciated that the present invention is as applicable to "double" panels as it is to "single" panels. By "single" panel is meant a panel as illustrated in FIG. 2. By "double" panel is meant the type of arrangement shown in the Thorowgood patent but with the improvements of this invention. The applicability of this is that the double sleeping bag of FIG. 8 (or even, less preferably FIG. 7) can be treated as a single panel of the type of FIG. 2, and accordingly can be folded in half so that the top panel 101 becomes the inside of a single bag and the bottom panel 101*d* the outside thereof. In fact, this provides a bag admirably suited for extra cold environments.

The peripheral fastening structure required for such an arrangement is adequately described in the Thorowgood Patent, U.S. Pat. No. 3,965,505.

Thus in the ensuing claims it is intended that the term panel covers the FIG. 2 and the FIGS. 7 and 8 disclosures.

I claim:

1. A sleeping bag constructed of a flexible panel folded in half to form upper and lower panel portions of said bag with adjacent edge sections having complementary fastening means thereon whereby to seal said bag except for an entrance opening at the head thereof; a pair of pockets respectively on the outer side of said upper and lower panel portions and each open at the head of the bag; a module removably fastened within each pocket and adapted to be folded outwardly therefrom, while still fastened, to form a pillow at the head of the bag; each module including a peripheral drawstring which when tightened draws said module into the form of a hood; and each pocket including fastening means on the opposed internal walls thereof whereby two modules can be fastened therein at the same time, to form a pillow and a hood for the bag.

2. A sleeping bag as claimed in claim 1 wherein the outer surfaces of said bag and modules are waterproof.

3. A sleeping bag as claimed in claim 1 wherein said panel and said modules are substantially rectangular.

4. A double sleeping bag comprising a pair of separable panels, a top panel and a bottom panel, the bottom panel being foldable in half to form upper and lower panel portions of a single sleeping bag with adjacent edge sections having complementary fastening means thereon whereby to seal said single bag except for an entrance opening at the head thereof; a pair of pockets respectively on the outer side of said bottom panel and each open at the head of the bag, said pockets being side by side when said panel forms the bottom panel part of said double sleeping bag, said pockets being located on the outside of said upper and lower panel portions when the bottom panel is folded to form a single sleeping bag; a module removably fastened within each pocket, and adapted to be folded outwardly therefrom while still fastened thereby forming a pillow at the head of the bag; each module including a peripheral drawstring which when tightened draws said module into the form of a hood.

5. A double sleeping bag as claimed in claim 4, wherein the top panel is of like construction to said bottom panel and each of the four pockets including fastening means on the opposed internal walls thereof whereby modules can be fastened therein at the same time, thereby forming a pair of hoods and a pair of pillows for the bag.

6. A double sleeping bag as claimed in claim 4 or claim 5 wherein the outer surfaces of said bag and modules are waterproof.

7. A sleeping bag as claimed in claim 4 or claim 5 wherein said panels and said modules are substantially rectangular.

* * * * *